United States Patent [19]

Lesher

[11] 4,403,448

[45] Sep. 13, 1983

[54] APPARATUS FOR CLOSING AND SEALING A DOORWAY

[75] Inventor: M. Kenneth Lesher, Rockford, Ill.

[73] Assignee: Alco Standard Corporation, Valley Forge, Pa.

[21] Appl. No.: 331,974

[22] Filed: Dec. 18, 1981

[51] Int. Cl.[3] ..... E05D 15/10

[52] U.S. Cl. ..... 49/225; 110/173 R

[58] Field of Search ..... 49/225, 209, 210, 216, 49/219, 220, 221; 110/173 R, 177

[56] References Cited

U.S. PATENT DOCUMENTS

| | | | |
|---|---|---|---|
| 3,059,290 | 10/1962 | Tobin | 49/225 |
| 3,399,875 | 9/1968 | Ipsen | 263/36 |
| 3,410,547 | 11/1968 | Bielefeldt | 266/5 |
| 3,558,112 | 1/1971 | Gaede | 263/36 |
| 3,583,690 | 6/1971 | Bornor | 263/36 |
| 4,165,667 | 8/1979 | Brolund et al. | 83/409 |

*Primary Examiner*—Philip C. Kannan

*Attorney, Agent, or Firm*—Leydig, Voit, Osann, Mayer & Holt, Ltd.

[57] ABSTRACT

A door is mounted on a carrier to move back and forth with the carrier between open and closed positions relative to a furnace doorway and to move inwardly relative to the carrier to seal the doorway. Bearing means engage the outer side of the carrier to support the carrier with rolling friction and to sustain the outward thrust which is imposed on the carrier when the door is moved inwardly to seal the doorway. The bearing means comprise a single spherical ball which is captivated in a cage to roll back and forth when the carrier is shifted and, at the same time, to spin universally about its own center.

5 Claims, 5 Drawing Figures

APPARATUS FOR CLOSING AND SEALING A DOORWAY

BACKGROUND OF THE INVENTION

This invention relates generally to apparatus for closing and sealing a doorway in a wall. More specifically, the invention relates to apparatus for closing and sealing a doorway which leads to the chamber of a furnace such as a vacuum furnace for brazing aluminum parts. A furnace of this general type is disclosed in Bielefeldt U.S. Pat. No. 3,609,295. During a typical process for brazing aluminum parts in a vacuum furnace, magnesium is vaporized in the furnace chamber in order to promote wetting of the aluminum surfaces and avoid the need for using flux. Moreau U.S. Pat. No. 3,673,678 discloses a fluxless brazing process in which magnesium is vaporized in the furnace chamber.

The apparatus for closing and sealing the doorway of the furnace chamber usually comprises a door which is mounted on the inner side of a door carrier to move with the carrier and also to move relative to the carrier. The carrier and the door are adapted to be shifted back and forth in unison along a path substantially paralleling the plane of the doorway to move the door between open and closed positions relative to the doorway. After the door has been moved to its closed position, it is shifted inwardly relative to the carrier and into tight engagement with the wall of the furnace chamber so as to seal the doorway. The door is shifted outwardly from sealing engagement with the wall prior to being moved to its open position.

Bearing means engage the outer side of the carrier to support the carrier with rolling friction as the carrier moves the door between its open and closed positions. The bearing means also sustain the outward reaction force which is imposed on the carrier when the door is shifted inwardly into sealing engagement with the furnace wall.

In prior door apparatus of the foregoing type, the bearing means have consisted of a ball bearing roller mounted to rotate about a fixed shaft. Rollers of this type experience a very short service life. The bearings become crushed by the outward force exerted by the carrier and, in addition, magnesium which accumulates in the vicinity of the furnace causes the bearings to gall and jam.

SUMMARY OF THE INVENTION

The general aim of the present invention is to provide new and improved door apparatus of the foregoing type and having unique bearing means which are more durable and trouble-free in service use than prior bearing means used for similar purposes.

A related object of the invention is to provide novel bearing means capable of withstanding the outward force of the door carrier without failing and capable of remaining free-rolling in spite of the presence of the magnesium, the bearing means being self-cleaning and preventing magnesium from building up and interfering with the rolling action.

A more detailed object is to achieve the foregoing by providing unique bearing means having a single spherical ball which is supported to spin universally about its own center and, at the same time, to roll back and forth along a defined path as the door carrier moves to open and close the door. Being capable of both spinning and rolling, the ball effectively cleans itself of magnesium which otherwise would cause jamming and galling. In addition, the ball can withstand high thrust loads without being crushed or otherwise damaged.

The invention also resides in the novel and relatively simple construction of a cage for captivating the ball for back and forth rolling while allowing the ball to spin universally about its own center, the cage insuring that the ball will roll back and forth each time the door is opened or closed.

These and other objects and advantages of the invention will become more apparent from the following detailed description when taken in conjunction with the accompanying drawings.

DETAILED DESCRIPTION OF THE PREFERRED EMBODIMENT

Figure 1:
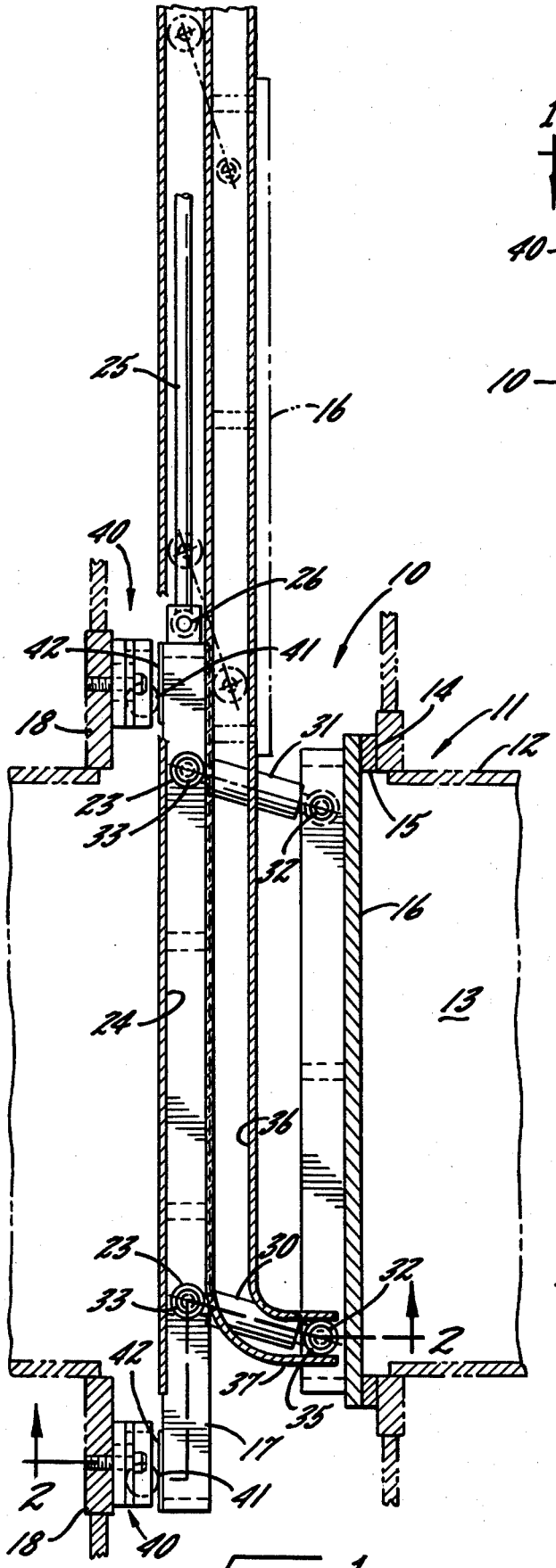
FIG. 1 is a fragmentary cross-section taken horizontally through a furnace equipped with new and improved bearing means incorporating the unique features of the present invention, the view being taken substantially along the line 1—1 of FIG. 2.

For purposes of illustration, the door apparatus 10 of the present invention has been shown in the drawings in conjunction with a furnace 11 such as a vacuum furnace for brazing aluminum parts (not shown). In certain aluminum brazing processes, magnesium is vaporized in the furnace and acts as a gettering agent.

The furnace 11 comprises a walled enclosure 12 defining a heating chamber 13 for receiving the parts. Heating elements (not shown) are adapted to heat the chamber to a high temperature while a vacuum pump (not shown) communicates with the chamber to evacuate the air therefrom and establish a vacuum in the chamber. The above-identified Bielefeldt patent contains a detailed disclosure of a typical vacuum brazing furnace.

One wall 14 of the enclosure 12 defines a doorway 15 through which the parts may be loaded into the chamber 13. The doorway is adapted to be selectively closed and sealed by a door 16. Herein, the door is supported by a door carrier 17 to move horizontally back and forth in unison with the carrier between open and closed positions relative to the doorway along a path extending substantially parallel to the plane of the doorway. In addition, the door is adapted to be shifted inwardly and outwardly relative to the carrier and into and out of sealing engagement with the wall 14 and sealing relationship with the doorway 15.

Figure 2:
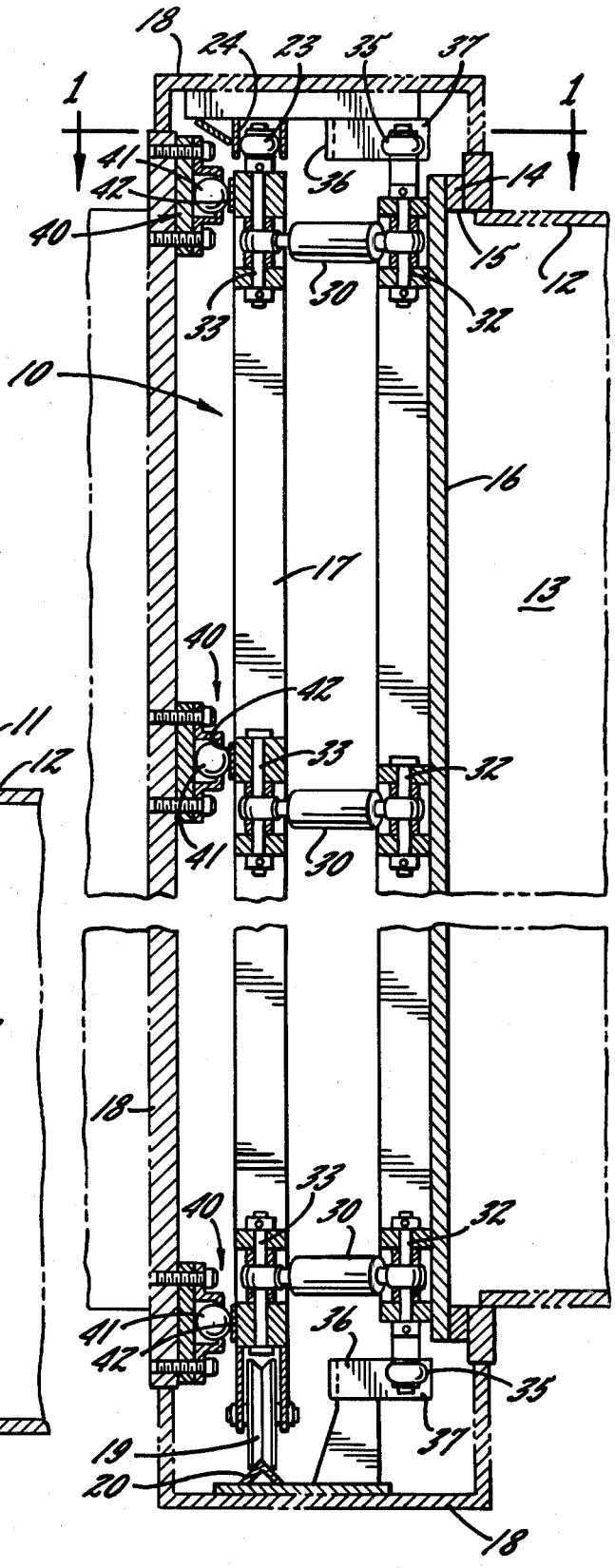
FIG. 2 is a fragmentary cross-section taken substantially along the line 2—2 of FIG. 1.

More specifically, the door carrier 17 is guided for back and forth horizontal movement on a main support structure or frame whose various parts have been collectively indicated by the reference numeral 18. Rollers 19 (FIG. 2) with V-shaped grooves are journaled on the lower end portion of the carrier to turn about horizontal axes and ride back and forth along V-shaped tracks 20 mounted on the frame 18. Additional rollers 23 are journaled on the upper end of the carrier 17 to turn about vertical axes and ride back and forth within channel-like tracks 24 on the frame. To effect back and forth horizontal movement of the carrier, a hydraulic actuator (not shown) is connected to the frame and includes a reciprocating rod 25 which is pivotally connected to the carrier at 26. When the rod is extended, the carrier 17 first shifts the door 16 horizontally from its open position shown in phantom lines in FIG. 1 to a closed but unsealed position in which the door is alined with but is spaced outwardly from the doorway 15. Thereafter, the door shifts inwardly relative to the carrier and moves into sealing engagement with the wall 14 as shown in solid lines in FIGS. 1 and 2.

The door 16 is connected to the door carrier 17 by a set of three vertically spaced front links 30 and by a set of three vertically spaced rear links 31, only one of the rear links being visible. The inner end of each link is pivotally connected to the door by a vertical pin 32 while the outer end of each link is connected pivotally to the carrier by a vertical pin 33. Each link may be of the spring-loaded type disclosed in Gaede U.S. Pat. No. 3,558,112. The rollers 23 are located above and are coaxial with the pins 33 of the upper links 30 and 31 of the two sets.

Coaxial with the pins 32 of the upper and lower links 30 of the forward set of links are upper and lower rollers 35 which ride within upper and lower channel-like tracks 36 on the frame 18. Near their forward ends, the latter tracks are curved inwardly as indicated at 37 in FIG. 1.

When the rod 25 is extended to shift the carrier 17 forwardly the door 16 moves horizontally from its open position and moves in unison with and parallel to the carrier until the rollers 35 engage the curved positions 37 of the tracks 36. Such engagement causes the links 30 to pivot about the pins 32 and 33 and cams the door 16 inwardly relative to the carrier 17 and into tight sealing engagement with the wall 14 to enable a vacuum to be established in the chamber 13. When the rod 25 is retracted, the door moves outwardly from the wall 14 until the rollers 35 engage the straight portions of the tracks 36. Continued retraction of the rod then causes the door to move with the carrier to its fully open position.

In accordance with the present invention, unique bearing assemblies 40 are located between the frame 18 and the outer side of the carrier 17 to support the carrier with rolling friction and to sustain the outward thrust which is imposed on the carrier when the door 16 shifts inwardly into sealing engagement with the wall 14. The bearing assemblies are particularly characterized by their ability to sustain heavy thrust loads without failing and by their ability to remain free-rolling in spite of the accumulation of magnesium in the vicinity of the bearing assemblies.

More particularly, six identical bearing assemblies 40 have been shown in the drawings, there being front and rear sets of three vertically spaced assemblies secured to the frame 18 and engageable with the outer side of the front and rear portions of the carrier 17 when the door 16 is in its closed position. Each bearing assembly comprises a spherical steel ball 41 (FIGS. 3 to 5) having a diameter of approximately 1½ inches and having a hardness of approximately 60 Rockwell C. Each ball is adapted to engage and roll against a hardened wear plate 42 (FIGS. 1 and 2) which is secured to the outer side of the carrier 17.

In carrying out the invention, the ball 41 of each bearing assembly 40 is uniquely captivated so as to roll back and forth when the carrier 17 is shifted and, at the same time, to spin universally about its own center. For this purpose, each ball is supported by a cage 44 (FIGS. 3 to 5) having a pair of mounting flanges 45 and having a retainer box 46. The ball is housed within the retainer box and engages a back-up plate 47. Screws 48 extend through elongated slots 49 in the flanges 45 and through elongated slots 50 in the back-up plate 47 and are threaded into the frame 18 to secure the cage and the back-up plate to the frame. The cage is hardened to about 40 Rockwell C while the back-up plate is hardened to about 55 Rockwell C.

Figure 3:
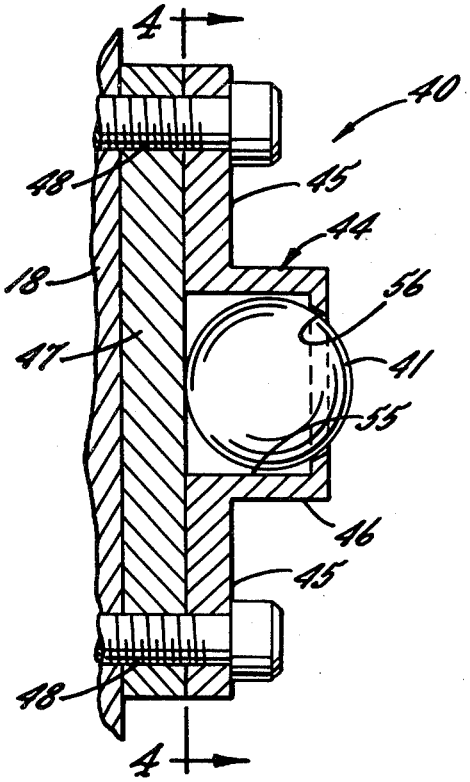
FIG. 3 is an enlarged view of one of the bearing means shown in FIG. 2.
Figure 4:
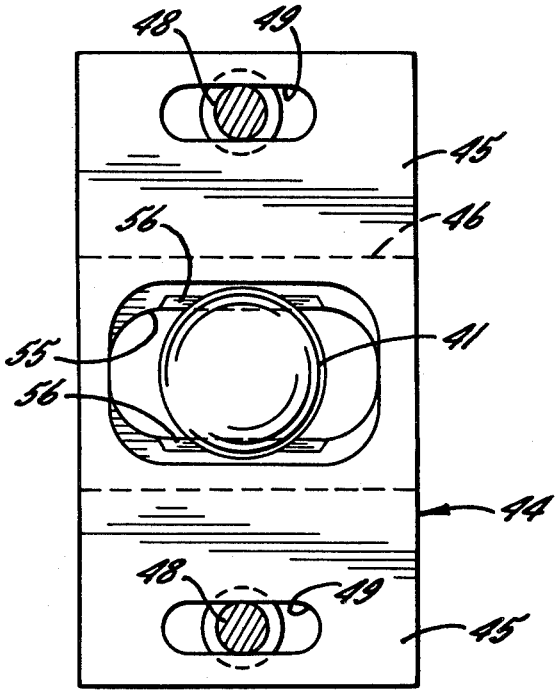
FIG. 4 is a cross-section taken substantially along the line 4—4 of FIG. 3.
Figure 5:
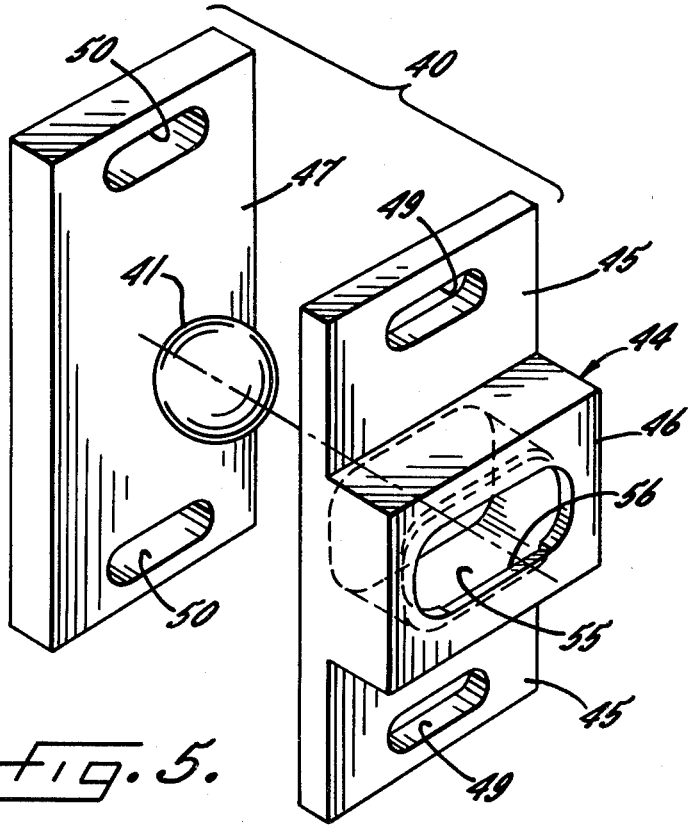
FIG. 5 is an exploded perspective view of the bearing means shown in FIG. 3.

As shown in FIGS. 3 to 5, the retainer box 46 is elongated in the fore-and-aft direction and its inner side is formed with a slot 55. The slot 55 extends completely through the inner side of the box 46 and also is elongated in a fore-and-aft direction. The major or fore-and-aft dimension of the slot is about 2½" while the minor or vertical dimension of the slot is about 1 3/16". Thus, the ball 41 is capable of rolling back and forth within the slot 55 with a portion of the ball projecting inwardly through the slot as shown in FIG. 3. The outer sides of the long edges of the slot are chamfered as indicated at 56 in FIG. 4 while the ends of the slot are rounded substantially in accordance with the diameter of the ball. The back-up plate 47 holds the ball against the chamfered edges of the slot.

With the foregoing arrangement, the ball 41 of each bearing assembly 40 rolls back and forth within the slot 55 of its cage 44 when the carrier 17 is shifted to move the door 16 between its open and closed positions. In addition, each ball spins universally about its own center. As a result of such rolling and spinning, the ball tends to clean itself and the cage of magnesium which accumulates in the area of the bearing assembly 40 by virtue of the brazing operation. The ball thus remains free-rolling and does not gall or seize. When the door 16 is shifted inwardly from its closed position to its sealed position, the ball sustains the outward force which is imposed on the carrier 17. Being hardened and being of relatively large diameter, the ball is capable of withstanding comparatively high forces without crushing or otherwise failing. Accordingly, the bearing assembly 40 is durable and is capable of experiencing a long service life.

Preferably, each bearing assembly is mounted on the frame 18 at a slight angle (e.g., ten degrees) such that the slot 55 slopes upwardly as the slot proceeds from the rear of the furnace 11 toward the front thereof. As a result, the carrier 17 forces the ball 41 to ride upwardly in the slot when the door 18 is shifted to its closed and sealed position and considerable force is exerted on the carrier and the ball. When the door is opened, gravity assists in moving the ball down the slot to insure that the ball returns to a starting position and does not become stuck in a position between the ends of the slot. The elongated slots 49 and 50 permit the bearing assembly to be mounted at a selected angle.

I claim:

1. Door apparatus for selectively closing and sealing a doorway in a wall, said door apparatus comprising a main support, a carrier having inner and outer sides, and a door on the inner side of said carrier, means mounting said carrier for back and forth movement on said support and enabling said carrier to move said door between open and closed positions relative to said doorway, said carrier and said door shifting back and forth along a path substantially parallel to the plane of the doorway as said carrier moves said door between said open and closed positions, means mounting said door on said carrier and enabling said door to shift inwardly and outwardly relative to said carrier and into and out of sealing engagement with said wall and sealing relationship with said doorway when said door is in said closed position, and bearing means for supporting said carrier with rolling friction as said carrier moves said door between said open and closed positions and for sustaining the outward force imposed on said carrier when said door is shifted inwardly into sealing engagement with said wall, said door apparatus being characterized in that said bearing means comprise a substantially spherical ball engageable with the outer side of said carrier, and means on said support and guding said ball to roll back and forth through a limited distance along a path substantially parallel to the path of said carrier while leaving said ball free to spin universally about is own center.

2. Door apparatus as defined in claim 1 in which said guiding means comprise a cage having an elongated slot formed in one side thereof, a portion of said ball projecting through said slot.

3. Door apparatus as defined in claim 2 in which said slot is elongated in the direction of the path of the ball, said slot having a major dimension greater than the diameter of said ball and having a minor dimension less than the diameter of said ball.

4. Door apparatus as defined in either of claims 2 or 3 further including a hardened back-up plate secured to said support, said ball being captivated between said cage and said back-up plate.

5. Door apparatus as defined in either of claims 2 or 3 in which said cage is inclined such that said slot is substantially horizontal but slopes upwardly as said slot proceeds in the direction ofthe closing movement of said door.

* * * * *